US005293855A

United States Patent [19]

Nakamura

[11] Patent Number: 5,293,855

[45] Date of Patent: Mar. 15, 1994

[54] ELECTRONIC THROTTLE VALVE DRIVE UNIT

[75] Inventor: Hideo Nakamura, Kanagawa, Japan

[73] Assignee: Nissan Motor Co., Ltd., Yokohama, Japan

[21] Appl. No.: 7,279

[22] Filed: Jan. 21, 1993

[30] Foreign Application Priority Data

Feb. 5, 1992 [JP] Japan ..... 4-020275

[51] Int. Cl.[5] ..... F02D 9/02; F02D 11/10

[52] U.S. Cl. ..... 123/399; 123/361

[58] Field of Search ..... 123/342, 352, 361, 399; 180/178, 179; 74/513

[56] References Cited

U.S. PATENT DOCUMENTS 5,002,032 3/1991 Kolberg ..... 123/399
5,014,201 5/1991 Tsukahara et al. ..... 123/352 X
5,048,484 9/1991 Terazawa et al. ..... 123/399 X
5,085,286 2/1992 Danzaki et al. ..... 123/352 X

FOREIGN PATENT DOCUMENTS 2-30933 2/1990 Japan .

*Primary Examiner*—Tony M. Argenbright
*Attorney, Agent, or Firm*—Foley & Lardner

[57] ABSTRACT

An electronic throttle valve drive unit comprises a return mechanism for returning two clutch plates of a first electromagnetic clutch interposed between an accelerator pedal and a throttle valve to a predetermined relative rotation angle position when the first electromagnetic clutch is returned to engagement from disengagement by cutoff of power supply.

5 Claims, 5 Drawing Sheets

POWER SUPPLY FOR MOTOR
(THROTTLE CONTROL MODULE)
HOLDING RELAY CIRCUIT
NORMALLY CLOSED
NORMALLY OPEN
POWER SUPPLY FOR CLUTCH
SET SWITCH
CANCEL SWITCH
MICROCOMPUTER
DIR
DUTY
CLUTCH
VB
ACCELERATOR SENSOR
THROTTLE SENSOR
SPEED SENSOR
1
4
5
6
8
9
11
12
21
22, 27
23
24
25
26
27
28
30
31
32
33
34
21, 22

ELECTRONIC THROTTLE VALVE DRIVE UNIT

BACKGROUND OF THE INVENTION

The present invention relates to an electronic throttle valve drive unit.

One of prior art electronic throttle valve drive units is disclosed, for example, in JP-A 2-30933.

This electronic throttle valve drive unit includes a first electromagnetic clutch of the normally closed type which is in engagement when no power is supplied, and a second electromagnetic clutch of the normally open type which is in disengagement when no power is supplied, the first electromagnetic clutch being interposed between an accelerator pedal and a throttle valve, and the second electromagnetic clutch being interposed between the throttle valve and a motor.

With such structure, if operation is made to supply power to the first and second electromagnetic clutches in the normal condition so as to open and close the throttle valve through the motor, and to shut off power to the first and second electromagnetic clutches in the abnormal condition, cruising of a motor vehicle is possible in directly opening and closing the throttle valve through the accelerator pedal.

However, the above operation cannot practically be obtained unless when returning to engagement from disengagement, the first electromagnetic clutch as interposed between the accelerator pedal and the throttle valve becomes in engagement in a predetermined relative rotation angle position wherein an accelerator pedal fully closed position corresponds to a throttle valve fully closed position.

By way of example, if, when an accelerator is fully opened, the first electromagnetic clutch is in engagement with the throttle valve fully closed, the throttle valve is difficult to open thereafter through the accelerator pedal. Additionally, if, when the accelerator is fully closed, the first electromagnetic clutch is in engagement with the throttle valve opened, the throttle valve is difficult to close thereafter through the accelerator pedal.

In order to avoid such state, it is possible to control, before engaging the first electromagnetic clutch, the relative rotation angle position of two clutch plates to its initial position through the motor. However, when the electromagnetic clutch falls in instantaneous engagement due to troubles such as impossible motor control and interrupted power supply of the electromagnetic clutch, this control may not provide sufficient measures.

It is, therefore, an object of the present invention to provide an electronic throttle valve drive unit which allows proper engagement of the two clutch plates of the first electromagnetic clutch interposed between the accelerator pedal and the throttle valve when the first electromagnetic clutch is returned to engagement from disengagement.

SUMMARY OF THE INVENTION

There is provided, according to the present invention, a drive unit for driving a throttle valve through an accelerator pedal and a motor, comprising:

a first electromagnetic clutch interposed between the accelerator pedal and the throttle valve, said first electromagnetic clutch being in engagement when no power is supplied, said first electromagnetic clutch being in disengagement when power is supplied, said first electromagnetic clutch including first and second clutch plates;

a second electromagnetic clutch interposed between the throttle valve and the motor, said second electromagnetic clutch being in disengagement when no power is supplied, said second electromagnetic clutch being in engagement when power is supplied; and means for returning said first and second clutch plates of said first electromagnetic clutch to a predetermined relative rotation angle position when said first electromagnetic clutch is returned to engagement from disengagement by cutoff of power supply of said first and second electromagnetic clutches.

DETAILED DESCRIPTION OF THE INVENTION

Figure 1:
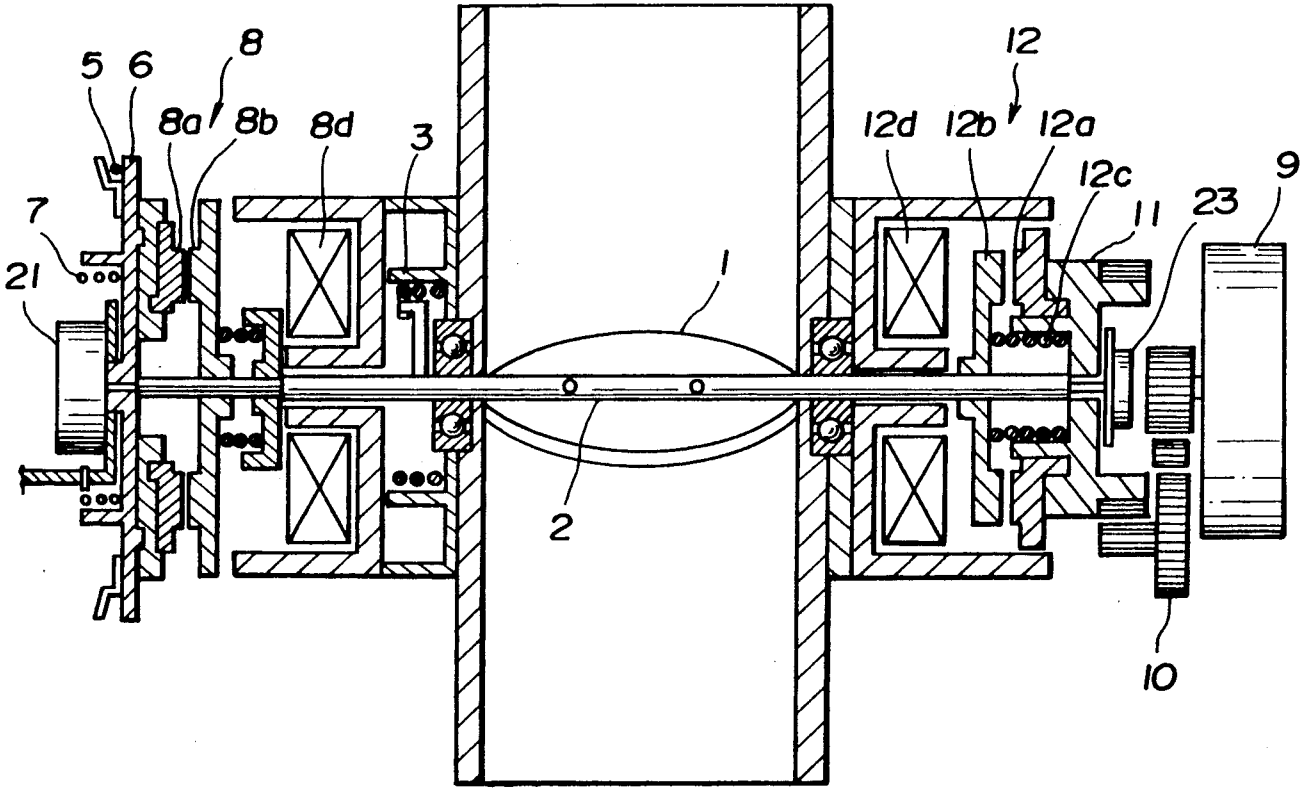
FIG. 1 is a schematic drawing showing a preferred embodiment of an electronic throttle drive unit according to the present invention.

Referring to the drawings, a preferred embodiment of the present invention will be described, which can ensure safety when using an electronic throttle drive unit of the aforementioned type, and carrying out, as throttle control by a motor, both automatic constant speed control or Automatic Speed Control Device (ASCD) control without an accelerator depressed and traction-characteristic-flavored control or accelerator-by-wire control with the accelerator depressed.

Referring to FIG. 1, a throttle valve 1 includes a valve shaft 2 on which a return spring 3 operates to bias the throttle valve 1 in the closed direction.

Rotatably supported to one end of the valve shaft 2 of the throttle valve 1 is an accelerator drum 6 connected to an accelerator pedal 4 (see FIG. 2) through a wire 5. A return spring 7 operates on the accelerator drum 6 to bias it in the closed direction.

A first electromagnetic clutch 8 is interposed between the accelerator drum 6 and the valve shaft 2.

The first electromagnetic clutch 8 includes a first clutch plate 8*a* mounted to the accelerator drum 6, and a second clutch plate 8*b* which is rotatable with the valve shaft 2 and slidable in the axial direction. The second clutch plate 8*b* is always biased by a spring 8*c* in the direction to engage with the first clutch plate 8*a*. Thus, the first electromagnetic clutch 8 becomes in engagement when no power is supplied to a coil 8*d*, and in disengagement when power is supplied thereto, i.e., it is of the normally closed type. The first electromagnetic clutch 8 provides a return mechanism which will be described later.

Rotatably supported to another end of the valve shaft 2 of the throttle valve 1 is a motor drum 11 which is driven by a DC motor 9 through a reduction gear 10.

A second electromagnetic clutch 12 is interposed between the motor drum 11 and the valve shaft 2.

The second electromagnetic clutch 12 includes a first clutch plate 12*a* mounted to the motor drum 11, and a second clutch plate 12*b* which is rotatable with the valve shaft 2 and slidable in the axial direction. The second clutch plate 12*b* is always biased by a spring 12*c* in the direction to disengage with the first clutch plate 12*a*. Thus, the second electromagnetic clutch 8 becomes in disengagement when no power is supplied to a coil 12*d*, and in engagement when power is supplied thereto, i.e., it is of the normally open type.

An accelerator sensor 21 of the potentiometer type is disposed in a predetermined position to measure a rotation angle of the accelerator drum 6. It is to be noted that an accelerator sensor system is a dual system, i.e., another accelerator sensor 22 (see FIG. 2) is provided for measuring a depression angle of the accelerator pedal 4.

Additionally, a throttle sensor 23 of the potentiometer type is disposed in a predetermined position to measure a rotation angle of the throttle valve 1.

Figure 2:
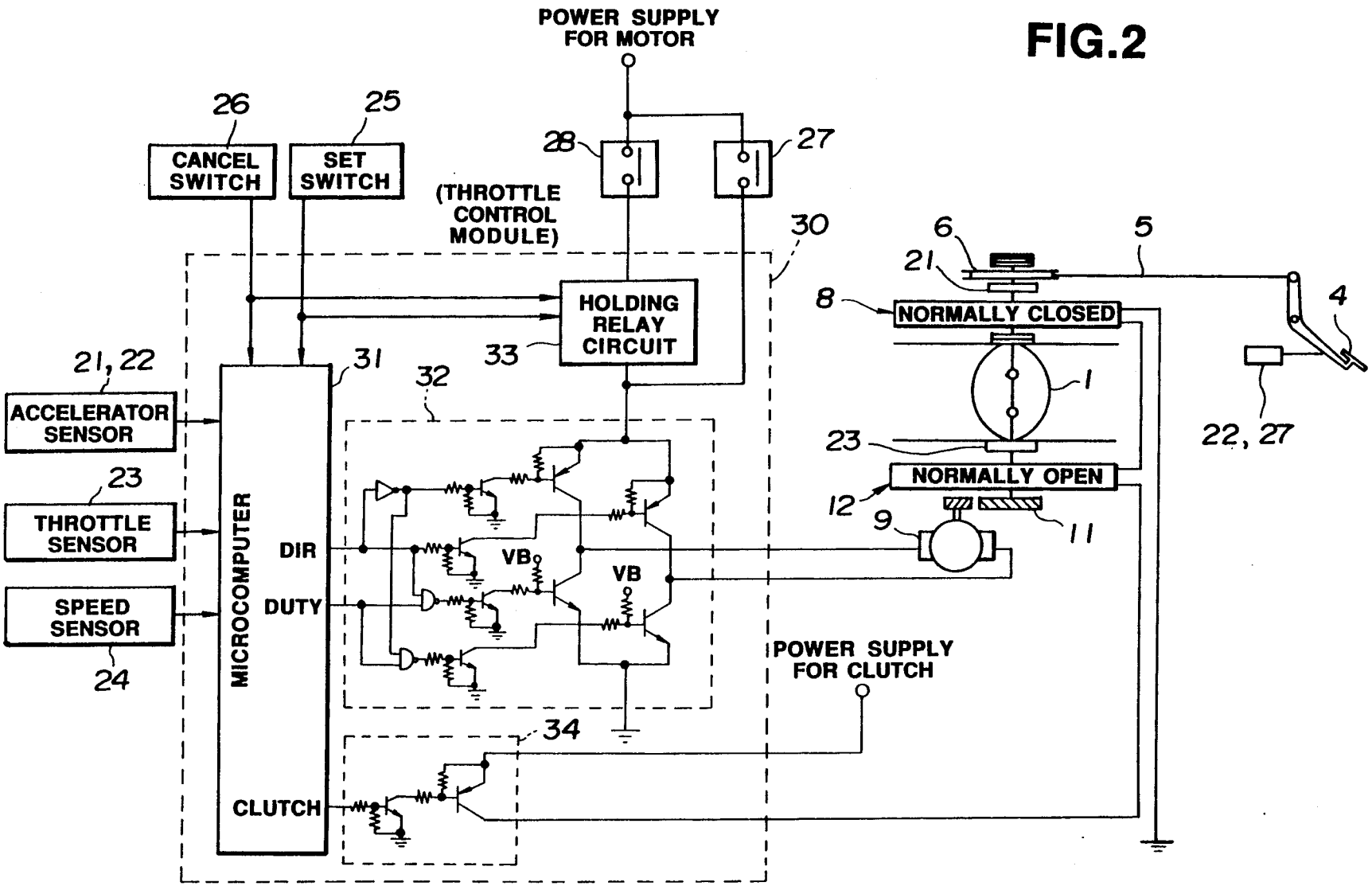
FIG. 2 is a block diagram showing a control system of the electronic throttle drive unit.

Referring to FIG. 2, the DC motor 9 and the first and second electromagnetic clutches 8, 12 as an electronic throttle drive unit are controlled and driven by a throttle control module 30 which inputs signals from the following sensors 21–24 and switches 25–28.

The accelerator sensors 21, 22 are arranged to detect an accelerator opening degree Acc based on output voltage of a potentiometer, respectively.

The throttle sensor 23 is arranged to detect a throttle opening degree Tvo based on output voltage of a potentiometer.

The speed sensor 24 is arranged to provide a pulse signal having frequency proportional to a vehicular speed Vsp through an electromagnetic pick-up, etc. arranged to a transmission output shaft.

The ASCD set switch 25 is arranged to direct a start of automatic constant speed control or ASCD control.

The ASCD cancel switch 26 is arranged to direct a cancellation of automatic constant speed control or ASCD control.

The accelerator limit switch 27 is arranged to turn on only when a brake pedal (not shown) is inoperative.

The throttle control module 30 comprises the following blocks 31–34.

The one-chip microcomputer 31 includes a CPU, a ROM, a RAM, an A/D port, a digital port, diverse timers, etc.

When a system is in normal condition, the microcomputer 31 outputs CLUTCH signal for directing power supply to the first and second electromagnetic clutches 8, 12. Additionally, the microcomputer 31 outputs DIR signal for directing the direction of rotation of the DC motor 9, and DUTY signal for directing drive current of the DC motor 9 so that an actual throttle opening degree corresponds to a target throttle opening degree which is computed in accordance with signals derived from the sensors and switches 21–28.

On the other hand, upon system failure, the microcomputer 31 outputs signals for initializing motor control signals (DIR, DUTY) and clutch control signal (CLUTCH), i.e., signals for directing cutoff of motor drive current and clutch drive current so as to shift throttle control by the DC motor 9 to throttle direct drive by the accelerator pedal 4.

The DC motor drive circuit 32 serves to control motor drive current and its direction by turning on only one of pairs of power transistors diagonally located in a DC motor drive bridge circuit in accordance with motor control signals (DIR, DUTY) derived from the microcomputer 31.

The holding relay circuit 33 only becomes the ON state when the ASCD set switch 25 is pressed, and thereafter it keeps the ON state until the cancel switch 26 is pressed, or the brake limit switch 28 is turned off with the brake pedal depressed, or an ignition switch (not shown) is turned off. A concrete structure of the holding relay circuit 33 corresponds to the prior art circuit having the above well-known function.

The electromagnetic clutch drive circuit 34 serves to turn on and off the power transistors in accordance with clutch control signal (CLUTCH) derived from the microcomputer 31. The power transistors, first electromagnetic clutch 8, and second electromagnetic clutch 12 are connected in series with each other. Specifically, the first and second electromagnetic clutches 8, 12 are electrically connected in series, and driven by the single drive circuit 34.

Figure 3:
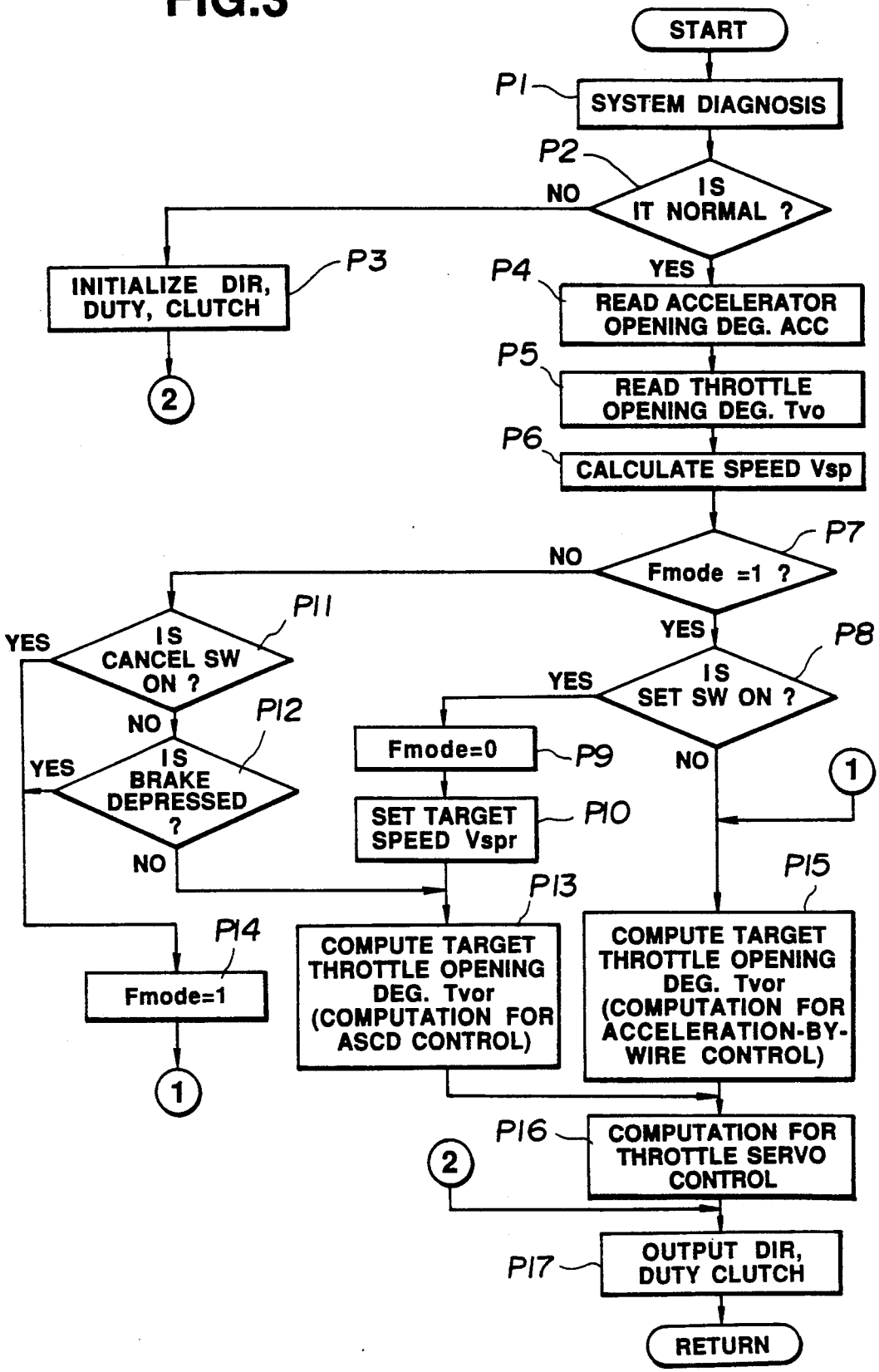
FIG. 3 is a flowchart showing control of the preferred embodiment in FIG. 1.

Referring to FIG. 3, the microcomputer 31 in the throttle control module 30 executes control operation every predetermined period of time, e.g., 10 msec.

At a step P1, a system diagnosis is carried out in accordance with signals derived from the sensors and switches 21–28 so as to verify presence of a failure.

At a step P2, it is determined, based on a result of the step P1, whether or not the system is in normal condition. If the system has a failure, control proceeds to a step P3, whereas the system is normal, control proceeds to a step P4.

Upon system failure, at a step P3, motor control signals (DIR, DUTY) and clutch control signal (CLUTCH) are initialized to zero. Then, control proceeds to a step P17 which will be described later, turning off output of motor control signals (DIR, DUTY) and clutch control signal (CLUTCH). As a result, drive current of the DC motor 9 is cut off to stop rotation thereof, and power supply of the first and second electromagnetic clutches 8, 12 is shut off so that the first electromagnetic clutch 8 becomes in engagement whereas the second electromagnetic clutch 12 becomes in disengagement, thus shifting throttle control by the DC motor 9 to throttle direct drive by the accelerator pedal 4.

In the normal condition, at steps P4 and P5, the accelerator opening degree Acc and the throttle opening degree Tvo are read from the sensors 21–23, and, at a step P6, the vehicular speed Vsp is read from the sensor 24 for calculation.

At a subsequent step P7, it is determined, based on a value of a flag switch Fmode, which of ASCD control and accelerator-by-wire control has been effective till now. IF Fmode=1, i.e., accelerator-by-wire control has been effective, control proceeds to a step P8, whereas if Fmode=0, i.e., ASCD control has been effective, control proceeds to a step P11.

During accelerator-by-wire control, at the step P8, it is determined whether or not the set switch 25 for directing a start of ASCD control is turned on. If the set switch 25 is turned on, control proceeds to a step P9 to start ASCD control, whereas if the set switch 25 is not turned on, control proceeds to a step P15 to continue accelerator-by-wire control.

When shifting to ASCD control, at the step P9, the flag switch Fmode is set to zero (Fmode=0). At a subsequent step P10, an actual vehicular speed Vspo is stored as a target vehicular speed Vspr, then control proceeds to a step P13.

At the step P13, computation for ASCD control is carried out. Specifically, a target throttle opening degree Tvor is computed based on a difference (Vspr−Vspo) between the actual vehicular speed Vspo and the target vehicular speed Vspr by using a known control method such as PID control or the like.

At a subsequent step P16, computation for throttle servo control is carried out. Specifically, DIR signal for directing the direction of rotation of the DC motor 9 and DUTY signal for directing motor drive signal are computed based on a difference ($Tvor-Tvo_0$) between an actual throttle opening degree $Tvo_0$ and the target throttle opening degree Tvor by using a known control method such as PID control or the like.

At a subsequent step P17, the microcomputer 31 writes DIR and DUTY signals in predetermined I/O registers to output them.

During ASCD control, at a step P11, it is determined whether or not the cancel switch 26 for directing a cancellation of ASCD control is turned on. If the cancel switch 26 is turned on, control proceeds to a step P14 to start accelerator-by-wire control, whereas if the cancel switch 26 is not turned on, control proceeds to a step P12.

At the step P12, it is determined whether or not the brake pedal is depressed based on turning-on and turning-off of the brake limit switch 28. If the brake pedal is depressed, control proceeds to a step P14 to start accelerator-by-wire, whereas if the brake pedal is not depressed, control proceeds to the step P13 to continue ASCD control.

When shifting to accelerator-by-wire control, at the step P14, the flag switch Fmode is set to 1 (Fmode=1), then control proceeds to a step P15.

At the step P15, computation for accelerator-by-wire control is carried out. Specifically, the target throttle opening degree Tvor is computed from an actual accelerator opening degree Acc in accordance with a map of accelerator opening degree vs. throttle opening degree previously prepared in view of characteristics of an engine and a vehicle.

At a subsequent step P16, computation for throttle servo control is carried out, then control proceeds to the step P17.

As described above, in the normal condition, power is supplied to the first and second electromagnetic clutches 8, 12, so that the first electromagnetic clutch 8 becomes in disengagement whereas the second electromagnetic clutch 12 becomes in engagement, carrying out throttle control (ASCD control or accelerator-by-wire control) by the DC motor 9.

It is to be noted that since the first and second electromagnetic clutches 8, 12 are electrically connected in series, and driven by the single drive circuit 34, the first and second electromagnetic clutches 8, 12 become simultaneously in a live state or in a non-live state. It is also to be noted that since wiring is so carried out that the first electromagnetic clutch 8 is disposed on the power supply side, and the second electromagnetic clutch 12 is disposed on the ground side, the first and second electromagnetic clutches 8, 12 become in disengagement together even if a harness between the first and second electromagnetic clutches 8, 12 is short-circuited to the ground.

Next, the structure relative to the present invention will be described.

The first electromagnetic clutch 8 as interposed between the accelerator and the throttle valve 1 provides the return mechanism for returning the two clutch plates 8*a*, 8*b* to a predetermined relative rotation angle position when returning to engagement from disengagement by cutoff of power supply of the first electromagnetic clutch 8.

Figure 4A:
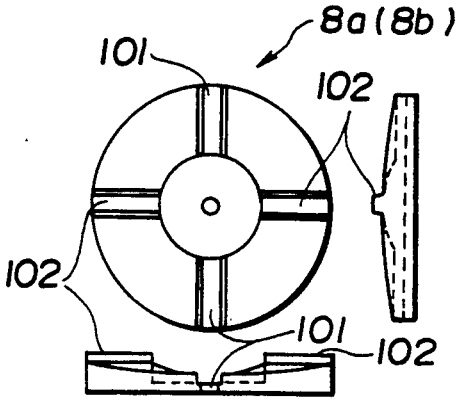
FIG. 4A is a diagrammatic view showing a clutch plate with a groove and a protrusion.
Figure 4B:
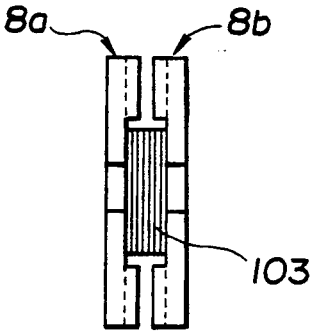
FIG. 4B is a view similar to FIG. 4A, showing two clutch plates and a spring interposed therebetween.
Figure 4C:
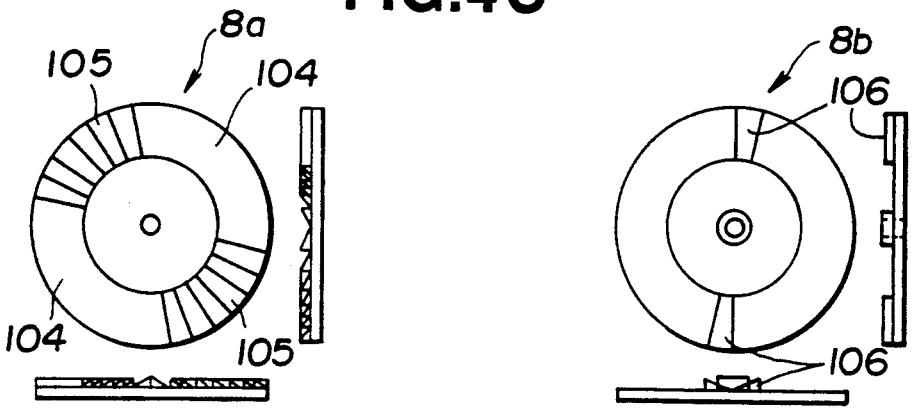
FIG. 4C is a view similar to FIG. 4B, showing two clutch plates, each having a plurality of protrusions.

This return mechanism may have concrete forms as shown in FIGS. 4A–4C.

Referring to FIG. 4A, one form of the return mechanism includes fixed position engagement inclined type clutch plates as the two clutch plates 8*a*, 8*b* of the first electromagnetic clutch 8. FIG. 4A shows a structural example of one of the fixed position engagement inclined type clutch plates. It is to be noted that the accelerator side clutch plate 8*a* and the throttle side clutch plate 8*b* are the same in shape.

Each of the clutch plates 8*a*, 8*b* has an engagement surface formed with two grooves 101 and two protrusions 102 which are alternately disposed every 90° of phase angle. Therefore, the two clutch plates 8*a*, 8*b* can be engaged with each other only in a predetermined relative rotation angle position, i.e., at every 180° point. The engagement surface of each of the clutch plates 8*a*, 8*b* is inclined in the direction to engage the groove 101 with the protrusion 102, or direction of the predetermined relative rotation angle position.

Referring to FIG. 4B, another form of the return mechanism includes a resilient member or a torsion coil spring 103 disposed between the two clutch plates 8*a*, 8*b* for biasing the two in the direction of the predetermined relative rotation angle position.

Specifically, the two clutch plates 8*a*, 8*b* are linked by the torsion coil spring 103 to bias the two in the direction of the predetermined relative rotation angle position. It is to be noted that the two clutch plates 8*a*, 8*b* are the same in shape.

Referring to FIG. 4C, the other form of the return mechanism includes partial one-way clutch plates.

The accelerator side clutch plate 8*a* has first and third quadrants which are plane to serve as free portions 104, and second and fourth quadrants which are formed with a plurality of protrusions having a plural-saw-tooth-like section to serve as one-way clutch portions 105.

The throttle side clutch plate 8*b* has an engagement portion formed with protrusions 106 having a single-saw-tooth-like section and disposed every 180° of phase angle.

That is, the return mechanism includes the accelerator side clutch plate 8*a* which is the partial one-way clutch plate constructed to alternately dispose every 90° of phase angle the non-engaged free portions 104 and the one-way clutch portions 105 for transmitting torque only in one direction relative to the engagement portion or protrusion 106 of the throttle side clutch plate 8*b*.

Next, the operation will be described with regard to each of the forms of the return mechanism as shown in FIGS. 4A–4C.

Figure 5A:
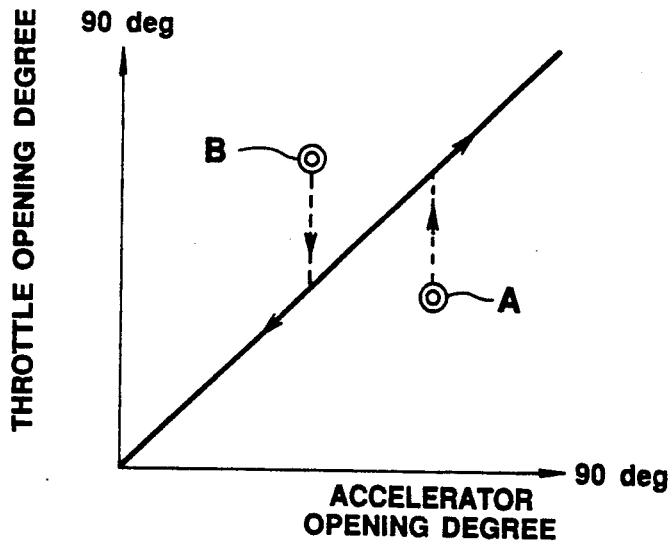
FIG. 5A is a graph showing operation of a first electromagnetic clutch of the type in FIG. 4A.

Referring to FIG. 5A, the operation will be described with regard to the form as shown in FIG. 4A.

If, immediately before cutoff of power supply of the first electromagnetic clutch 8, the throttle opening degree is smaller than the accelerator opening degree (see a double circle A in FIG. 5A), the two clutch plates 8*a*, 8*b* are engaged with each other after the throttle opening degree is increased up to the accelerator opening degree by torque in the direction of the predetermined relative rotation angle position which is produced by inclination of the engagement surfaces of the two clutch plates 8*a*, 8*b* and force of the spring 8*c* for pressing the two.

On the other hand, if, immediately before cutoff of power supply of the first electromagnetic clutch 8, the throttle opening degree is larger than the accelerator opening degree (see a double circle B in FIG. 5A), the two clutch plates 8*a*, 8*b* are engaged with each other when the throttle opening degree corresponds to the accelerator opening degree by resultant of force of the return spring 3 for biasing the throttle valve 1 in the fully closed direction, and torque in the predetermined relative rotation angle position which is produced by inclination of the engagement surfaces of the two clutch plates 8*a*, 8*b* and force of the spring 8*c* for pressing the two.

Therefore, if power supply of the first and second electromagnetic clutches 8, 12 is shut off when detecting a system failure, etc., the second electromagnetic clutch 12 as interposed between the motor 9 and the throttle valve 1 is opened, whereas the accelerator side clutch plate 8*a* and the throttle side clutch plate 8*b* of the first electromagnetic clutch 8 as interposed between the accelerator and the throttle valve 1 are returned to the initial relative rotation angle position without offset, allowing normal adjustment of the throttle opening degree by accelerator operation.

It is to be noted that an inclination angle of the clutch plates 8*a*, 8*b* and a friction coefficient thereof should appropriately be established in view of great influence on torque for returning the clutch plates 8*a*, 8*b* in the direction of the starting point.

Figure 5B:
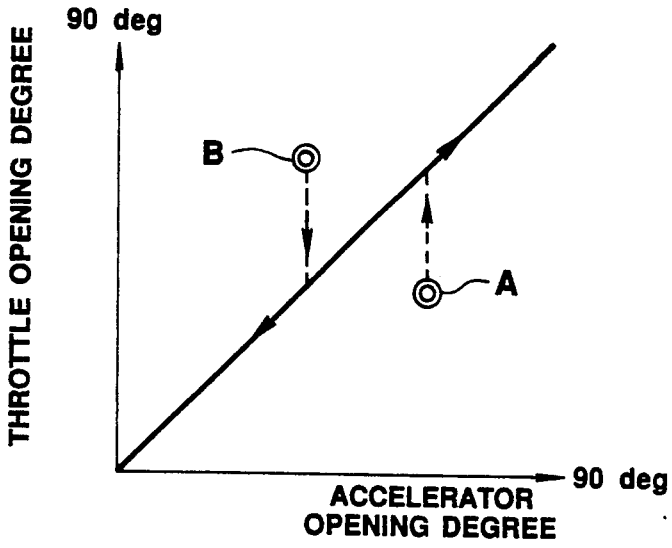
FIG. 5B is a view similar to FIG. 5A, but of the type in FIG. 4B.

Referring to FIG. 5B, the operation will be described with regard to the form as shown in FIG. 4B.

Immediately after cutoff of power supply of the first electromagnetic clutch 8, the torsion coil spring 103 provides to the throttle side clutch plate 8*b*, before the two clutch plates 8*a*, 8*b* are fully engaged with each other, torque in the direction of the predetermined relative rotation angle position in connection with the accelerator side clutch plate 8*a*, thus returning the throttle side clutch plate 8*b* in the predetermined relative rotation angle position.

It is to be noted that a time for engagement of the two clutch plates 8*a*, 8*b* should be determined in view of a characteristic of the torsion coil spring 103, etc. since return operation requires a certain time interval.

Figure 5C:
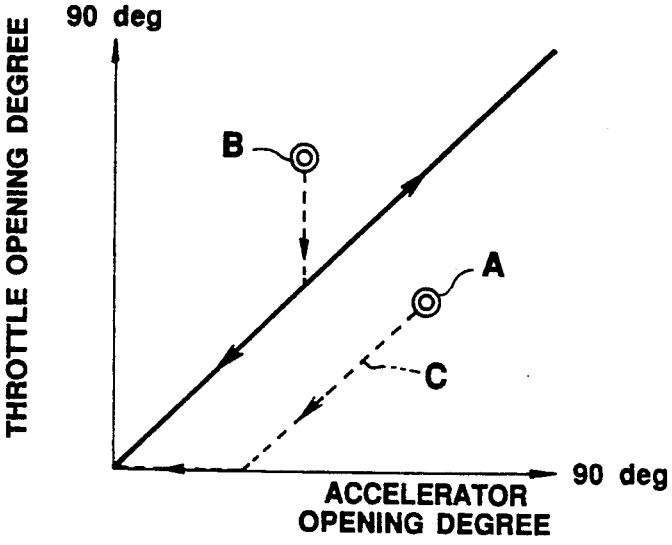
FIG. 5C is a view similar to FIG. 5B, but of the type in FIG. 4C.

Referring to FIG. 5C, the operation will be described with regard to the form as shown in FIG. 4C.

If, immediately before cutoff of power supply of the first electromagnetic clutch 8, the throttle opening degree is larger than the accelerator opening degree (see a double circle B in FIG. 5C), the free portions 104 of the accelerator side clutch plate 8*a* become effective. Thus, the throttle side clutch plate 8*b* is urged to slide in the closed direction, then it is engaged with the accelerator side clutch plate 8*a* in the predetermined relative rotation angle position wherein engagement of the two clutch plates 8*a*, 8*b* is possible for the first time through boundaries of the free portions 104 and the one-way clutch portions 105.

If, immediately before cutoff of power supply of the first electromagnetic clutch 8, the throttle opening degree is smaller than the accelerator opening degree (see a double circle A in FIG. 5C), the one-way clutch portions 105 become effective. Thus, the two clutch plates 8*a*, 8*b* are engaged with each other at once with the relative rotation angle immediately before cutoff of power supply. Thereafter, when a driver turns the accelerator off, a fully closed position stopper of the throttle valve 1 and the one-way clutch portions 105 cooperate to cancel offset of the rotation angle, returning to the predetermined relative rotation angle position.

Additionally, even if power supply of the first and second electromagnetic clutches 8, 12 is shut off upon system failure, the throttle valve 1 fails to be fully closed at once, temporarily holding a relative angle of the accelerator opening degree vs. the throttle opening degree (see a broken line C in FIG. 5C).

What is claimed is:

1. A drive unit for driving a throttle valve through an accelerator pedal and a motor, comprising:

a first electromagnetic clutch interposed between the accelerator pedal and the throttle valve, said first electromagnetic clutch being in engagement when no power is supplied, said first electromagnetic clutch being in disengagement when power is supplied, said first electromagnetic clutch including first and second clutch plates;

a second electromagnetic clutch interposed between the throttle valve and the motor, said second electromagnetic clutch being in disengagement when no power is supplied, said second electromagnetic clutch being in engagement when power is supplied; and means for returning said first and second clutch plates of said first electromagnetic clutch to a predetermined relative rotation angle position when said first electromagnetic clutch is returned to engagement from disengagement by cutoff of power supply of said first and second electromagnetic clutches.

2. A drive unit as claimed in claim 1, wherein said returning means include said first and second clutch plates of said first electromagnetic clutch, each including a fixed position engagement inclined type clutch plate having an engagement surface formed with two radially extending grooves and two radially extending protrusions alternately disposed every 90° of phase angle.

3. A drive unit as claimed in claim 1, wherein said returning means include a resilient member interposed between said first and second clutch plates of said first electromagnetic clutch.

4. A drive unit as claimed in claim 3, wherein said resilient member includes a torsion coil spring.

5. A drive unit as claimed in claim 1, wherein said returning means include said first and second clutch plates, said first clutch plate including a partial one-way clutch plate having an engagement surface formed with two flat portions and two one-way clutch portions alternately disposed every 90° of phase angle, said second clutch plate including a clutch plate having an engagement surface formed with two protrusions disposed every 180° of phase angle.

* * * * *